US010004959B1

(12) United States Patent
Myers

(10) Patent No.: US 10,004,959 B1
(45) Date of Patent: Jun. 26, 2018

(54) PUTTER WITH REPLACEABLE FACE INSERT

(71) Applicant: Callaway Golf Company, Carlsbad, CA (US)

(72) Inventor: Matthew Myers, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days. days.

(21) Appl. No.: 15/815,093

(22) Filed: Nov. 16, 2017

(51) Int. Cl.
*A63B 53/04* (2015.01)
*A63B 53/06* (2015.01)
*A63B 53/00* (2015.01)

(52) U.S. Cl.
CPC ..... *A63B 53/065* (2013.01); *A63B 53/007* (2013.01); *A63B 53/04* (2013.01); *A63B 53/0487* (2013.01); *A63B 2053/0416* (2013.01); *A63B 2053/0433* (2013.01); *A63B 2053/0437* (2013.01)

(58) Field of Classification Search
CPC . A63B 53/007; A63B 53/0487; A63B 53/065; A63B 2053/0416; A63B 2053/0433; A63B 2053/0437; A63B 53/04
USPC ..... 473/342, 340, 345
See application file for complete search history.

(56) References Cited

U.S. PATENT DOCUMENTS 2,386,552 A * 10/1945 Hill ..... A63B 53/06 473/245
4,884,808 A * 12/1989 Retzer ..... A63B 53/04 473/288
5,275,413 A * 1/1994 Sprague ..... A63B 53/0487 473/337
2007/0111813 A1* 5/2007 Edel ..... A63B 53/007 473/288
2012/0088599 A1* 4/2012 Narita ..... A63B 53/0487 473/329

* cited by examiner

*Primary Examiner* — Benjamin Layno
(74) *Attorney, Agent, or Firm* — Rebecca Hanovice; Michael Catania; Sonia Lari

(57) ABSTRACT

A golf club head, preferably a putter head, comprising a replaceable face insert is disclosed herein. The golf club head comprises a body with face cavity and a secondary cavity in communication with, and disposed behind, the face cavity, and at least one opening extending through a top or sole portion into the secondary cavity. The replaceable face insert comprises a striking portion and a support structure having an elongated, vertical through bore extending from a rear surface of the striking portion. The support structure is received within the secondary cavity and the striking portion is received within the face cavity, and then a rod or bolt is inserted through the opening and into the elongated, vertical through bore to reversibly secure the face insert to the body. A linear bearing may be disposed within the elongated through bore to receive the rod or bolt.

20 Claims, 9 Drawing Sheets

PUTTER WITH REPLACEABLE FACE INSERT

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

Field of the Invention

The present invention relates to a golf club head, particularly a putter, with a structure for receiving a replaceable face insert.

Description of the Related Art

Putters typically include face inserts that are permanently bonded within a frontal recess. It is difficult to remove a face insert once it is bonded into the putter head, and doing so risks causing to the face insert itself and the rest of the putter body. There a need, therefore, for a putter with a putter face replacement system that allows a golfer to change the type of face insert without causing damage to the putter.

BRIEF SUMMARY OF THE INVENTION

One aspect of the present invention is a golf club head, and particularly a putter, comprising a structure designed to receive and retain a replaceable face insert.

Another aspect of the present invention is a putter head comprising a body comprising a front surface, a top portion extending from an upper edge of the front surface, a sole portion extending from a lower edge of the front surface, a rear portion, a first cavity extending into the front surface, a second cavity disposed behind, and in communication with, the first cavity, and a top opening extending through the top portion and in communication with the second cavity, a face insert comprising a striking portion comprising a striking surface and a rear surface opposite the striking surface, the striking portion sized to fit within the first cavity, a support structure extending from the rear surface, the support structure sized to fit within the second cavity, and an elongated through-bore extending through the support structure in a top-to-bottom direction, a rod sized to fit through the top opening and within the elongated through-bore, the first rod comprising an upper end and a lower end, and a cover, wherein, when the striking portion is disposed within the first cavity and the support structure is disposed within the second cavity, the elongated through-bore is vertically aligned with the top opening, wherein, when the striking portion is disposed within the first cavity and the support structure is disposed within the second cavity, the rod is inserted into the elongated through-bore via the top opening and extends through the elongated through-bore so that the lower end abuts the sole portion, and wherein the cover is affixed to the top portion so that the upper end of the rod abuts a portion of the cover.

In some embodiments, each of the upper and lower ends of the rod may be tapered. In other embodiments, the putter head may comprise a linear bearing disposed within the elongated through-bore. In a further embodiment, the putter head may comprise first and second snap rings, the support structure may comprise a first circular groove proximate an upper end of the elongated through-bore and a second circular groove proximate a lower end of the elongated through-bore, the first snap ring may be disposed within the first circular groove above the linear bearing, and the second snap ring may be disposed within the second circular groove below the linear bearing. In other embodiments, the sole portion may comprise a sole internal surface having a depression sized to receive the lower end of the rod. In still other embodiments, the cover may comprise a cover internal surface, and a boss sized to receive the upper end of the rod may extend from the cover internal surface and is aligned with the top opening when the cover is affixed to the body. In still other embodiments, the rod may be compressed between the cover and the sole portion. In any of the embodiments, the cover may comprise an outer surface having alignment markings. Also, in any of the embodiments, the cover may be reversibly affixed to the body, and a sealing gasket may extend around a periphery of the striking portion.

Yet another aspect of the present invention is a putter head comprising a body comprising a front surface, a top portion extending from an upper edge of the front surface, a sole portion extending from a lower edge of the front surface, a heel side, a toe side, a face cavity extending into the front surface, a heel side cavity disposed behind, and in communication with, the face cavity, a toe side cavity disposed behind, and in communication with, the face cavity, a heel side top opening extending through the top portion and in communication with the heel side cavity, and a toe side top opening extending through the top portion and in communication with the toe side cavity, a face insert comprising a striking portion comprising a striking surface and a rear surface opposite the striking surface, a heel side support structure extending from the rear surface and comprising a first elongated through-bore, and a toe side support structure extending from the rear surface and comprising a second elongated through-bore, first and second tapered rods, and a cover comprising an external surface with alignment markings, wherein the striking portion is sized to fit within the face cavity so that the striking surface is approximately flush with a portion of the front surface, wherein the heel side support structure is sized to fit within the heel side cavity so that the first elongated through-bore aligns with the heel side top opening, wherein the toe side support structure is sized to fit within the toe side cavity so that the second elongated through-bore aligns with the toe side top opening, wherein the first tapered rod is disposed within the first elongated through-bore and is trapped between the sole portion and the cover, and wherein the second tapered rod is disposed within the second elongated through-bore and is trapped between the sole portion and the cover.

In some embodiments, the cover may comprise an internal surface with heel and toe side bosses, an upper end of the first tapered rod may be received in the heel side boss, and an upper end of the second tapered rod may be received in the toe side boss. In other embodiments, the sole portion may comprise a heel side depression and a toe side depression, the heel side depression may be located within the heel side cavity and is vertically aligned with the heel side top opening, the toe side depression may be located within the toe side cavity and is vertically aligned with the toe side top opening, the heel side depression may receive a lower end of the first tapered rod, and the toe side depression may receive a lower end of the second tapered rod. In still other embodiments, the putter head may further comprise a first linear bearing disposed within the first elongated through-bore and around the first tapered rod and a second linear bearing disposed within the second elongated through-bore and around the second tapered rod. In other embodiments, a sealing gasket may extend around a periphery of the striking portion.

Another aspect of the present invention is a putter head comprising a body comprising a front surface, a top portion extending from an upper edge of the front surface, a sole portion extending from a lower edge of the front surface, a first cavity extending into the front surface, a second cavity disposed behind, and in communication with, the first cavity, a sole opening extending through the sole portion and in communication with the second cavity, and a threaded bore extending into an inner surface of the top portion, a face insert comprising a striking portion comprising a striking surface and a rear surface opposite the striking surface, a support structure extending from the rear surface, and an elongated through-bore extending through the support structure in a top-to-bottom direction, and a mechanical fastener comprising a head portion, an extension portion, and a threaded portion, wherein the sole opening is encircled by a flange portion, wherein the threaded bore is in communication with the second cavity and is vertically aligned with the sole opening, wherein the striking portion is sized to fit within the first cavity so that the striking surface is approximately flush with a portion of the front surface, wherein the support structure is sized to fit within the second cavity so that the elongated through-bore aligns with the sole opening and the threaded bore, and wherein the threaded portion of the mechanical fastener engages the threaded bore, the extension portion of the mechanical fastener extends through the elongated through-bore, and the head portion abuts the flange portion to reversibly fix the face insert to the body.

In some embodiments, the putter head may further comprise a linear bearing, which may be disposed within the elongated through-bore, and the extension portion may extend through the linear bearing. In a further embodiment, the putter head may further comprise first and second snap rings, the support structure may comprise a first circular groove proximate an upper end of the elongated through-bore and a second circular groove proximate a lower end of the elongated through-bore, the first snap ring may be disposed within the first circular groove above the linear bearing, and the second snap ring may be disposed within the second circular groove below the linear bearing. In any of the embodiments, the putter head may comprise a sealing gasket extending around a periphery of the striking portion. In some embodiments, the support structure may be approximately cylindrical.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
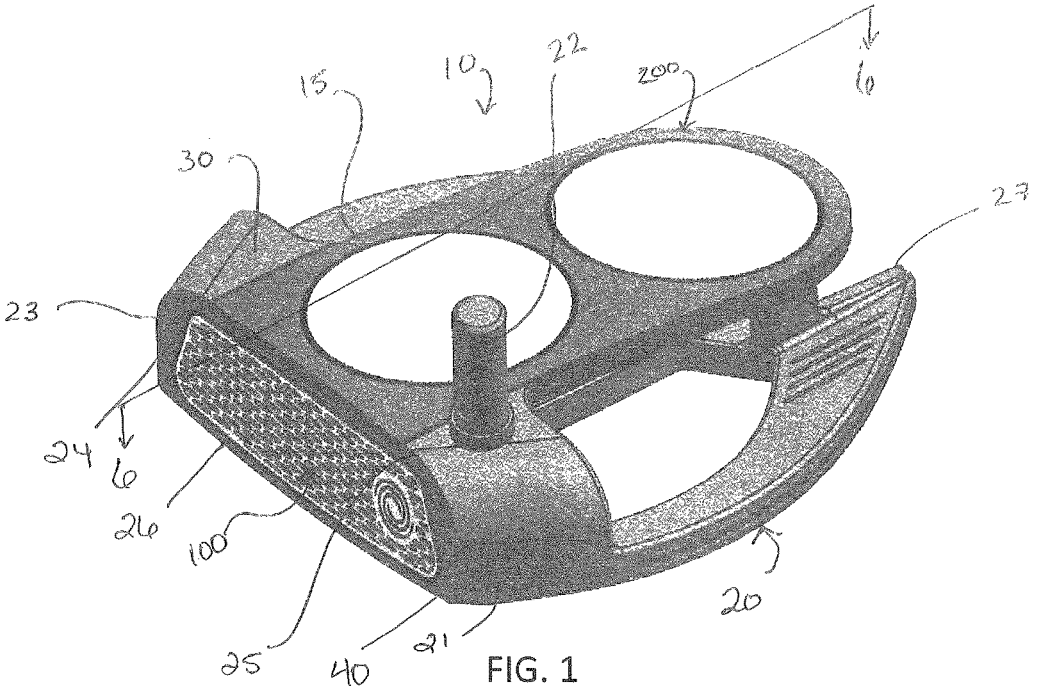
FIG. 1 is a top perspective view of a first embodiment of the putter head of the present invention.
Figure 2:
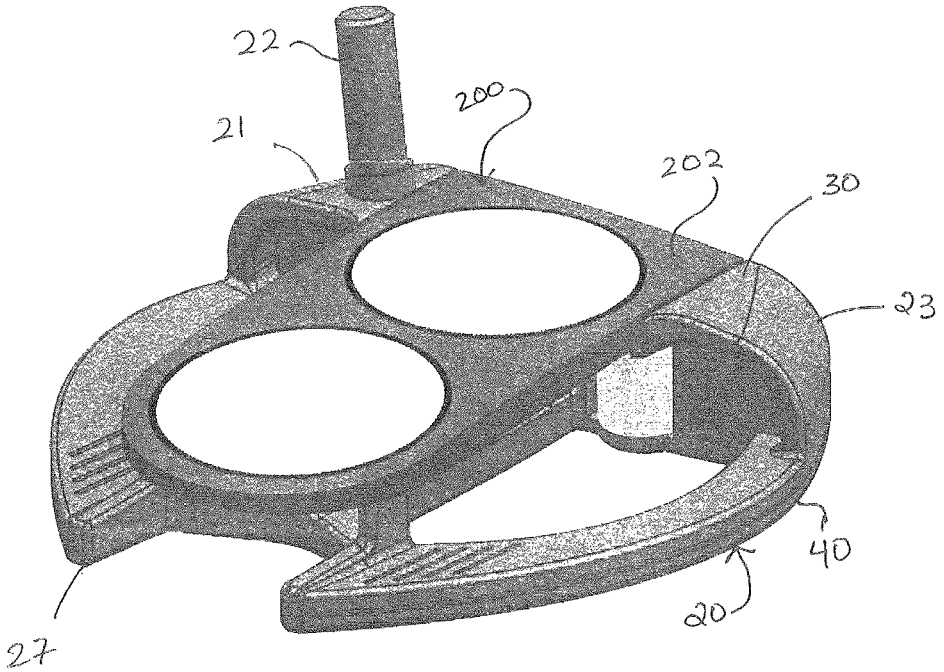
FIG. 2 is a rear perspective view of the putter head shown in FIG. 1.
Figure 3:
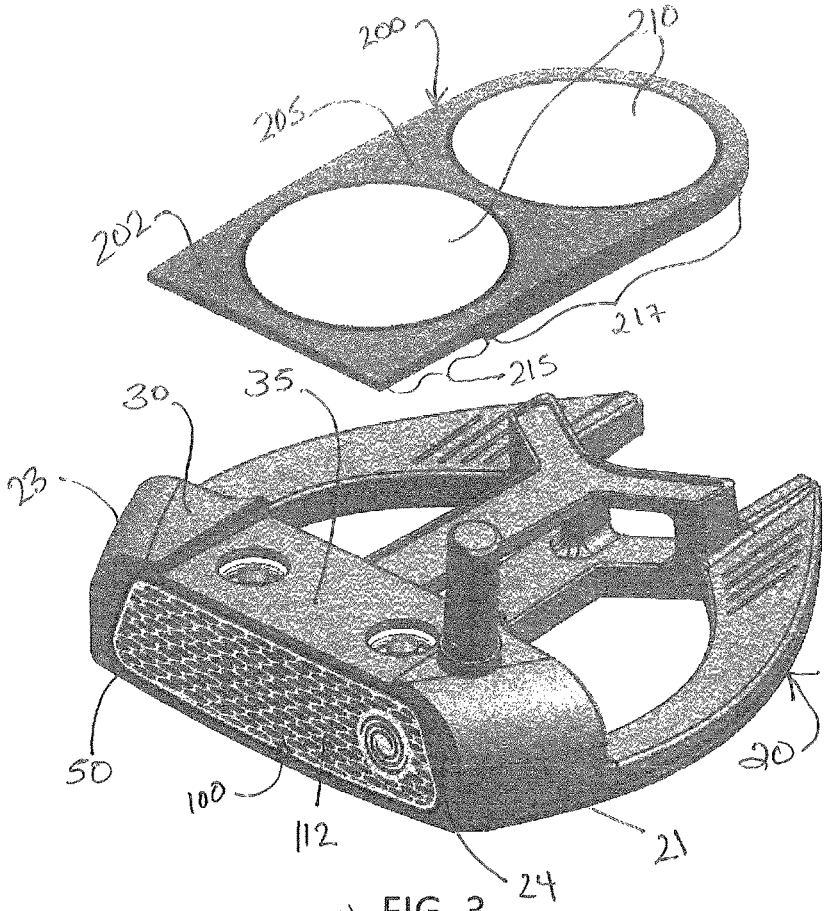
FIG. 3 is a partially exploded view of the putter head shown in FIG. 1.
Figure 4:
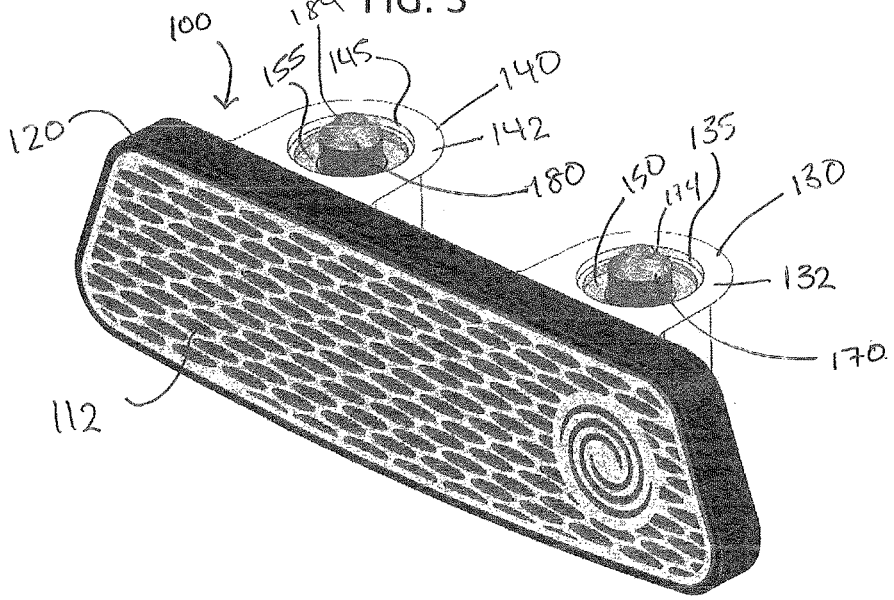
FIG. 4 is a front perspective view of the face insert shown in FIG. 1.
Figure 5:
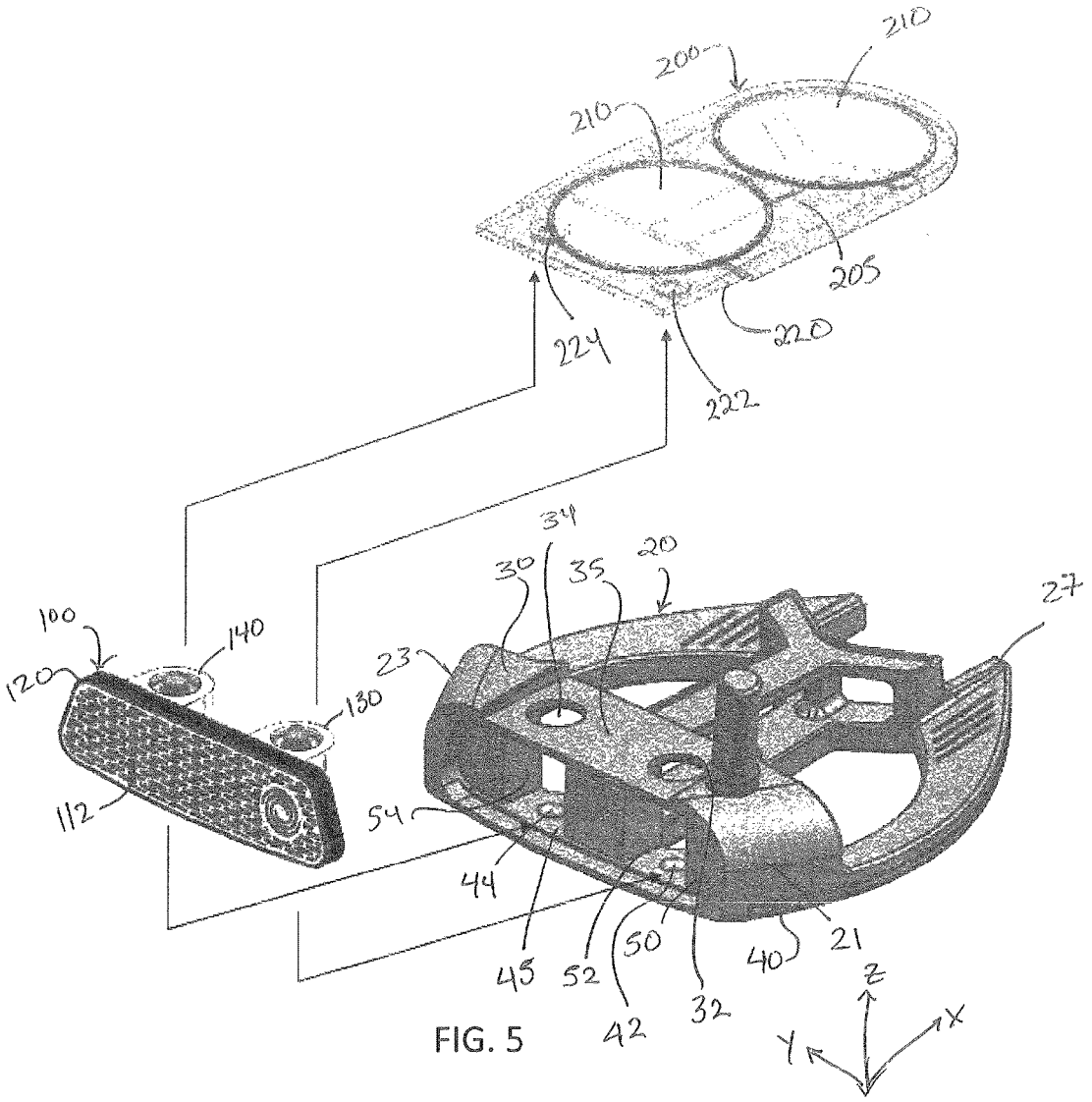
FIG. 5 is an exploded view of the putter head shown in FIG. 1.
Figure 6:
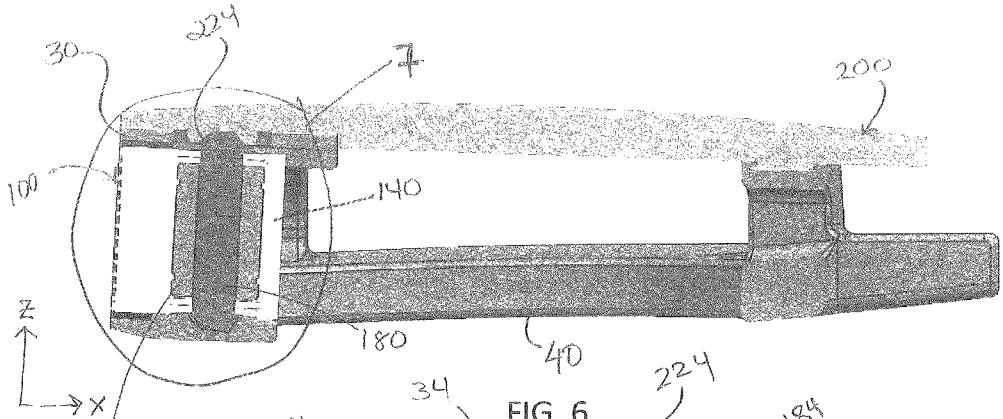
FIG. 6 is a cross-sectional view of the putter head shown in FIG. 1 along lines 6-6.
Figure 7:
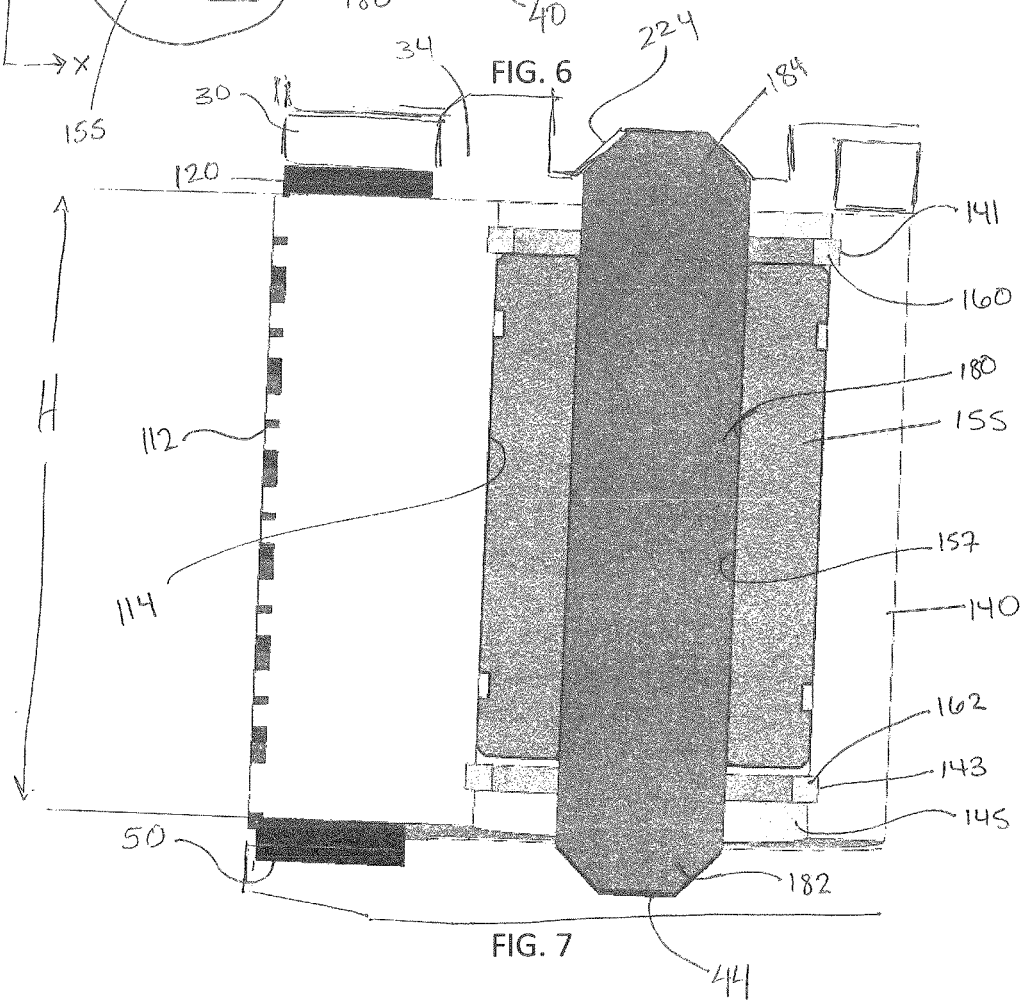
FIG. 7 is an enlarged view of the circled portion of the putter head shown in FIG. 6.
Figure 8:
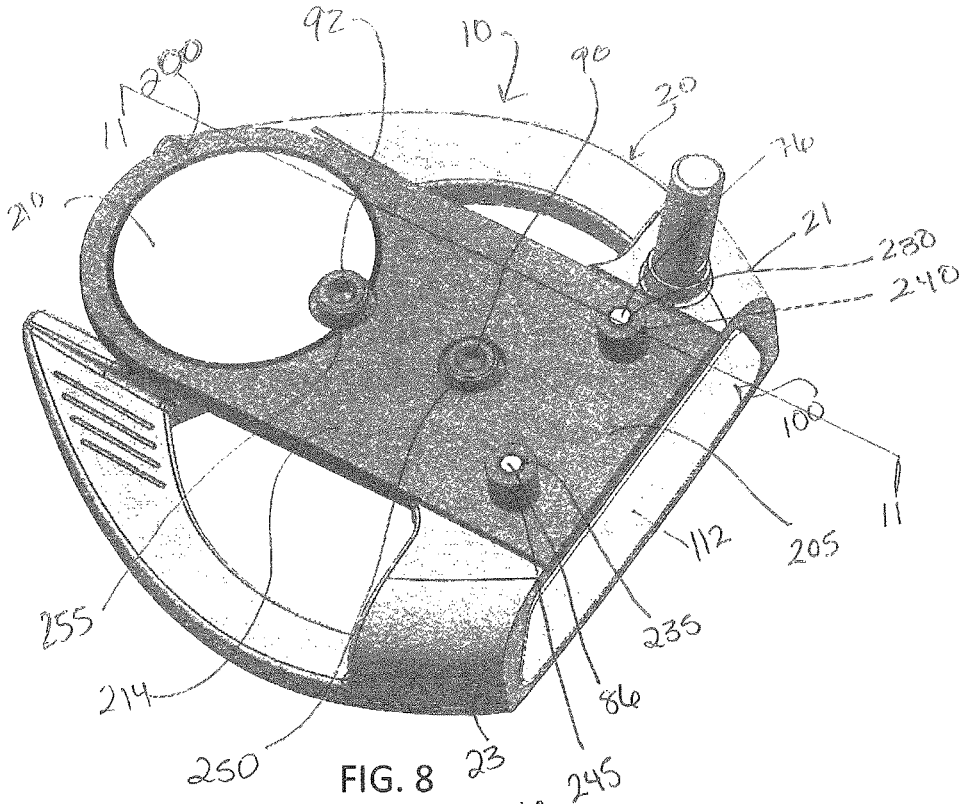
FIG. 8 is a top perspective view of a second embodiment of the putter head of the present invention.
Figure 9:
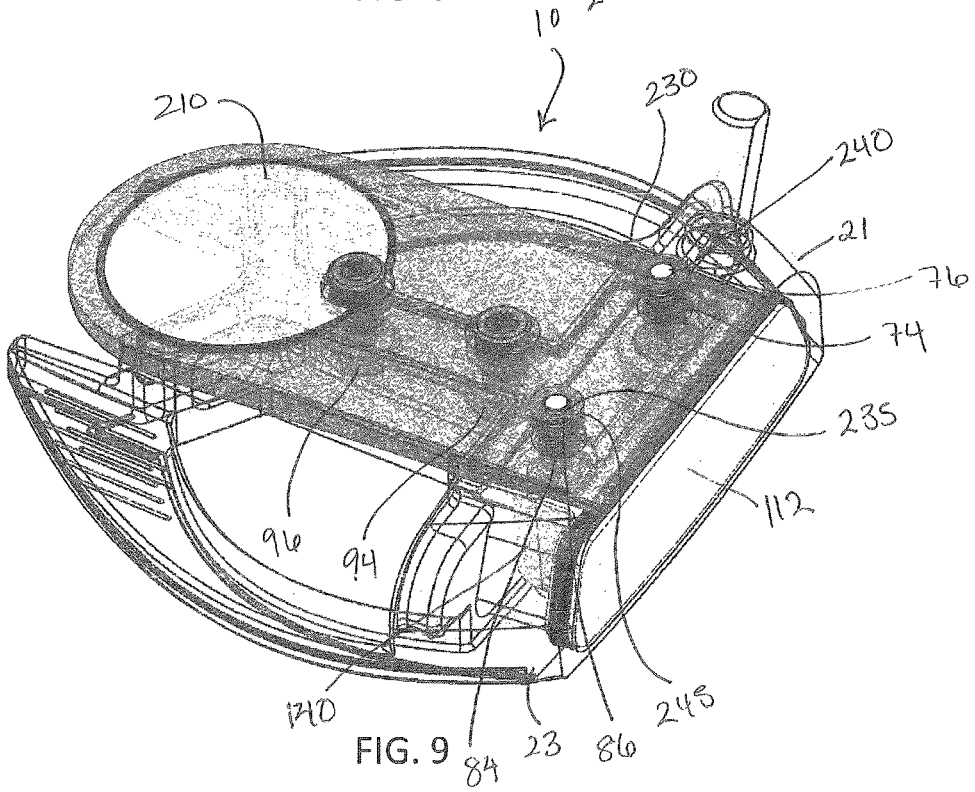
FIG. 9 is a partially transparent view of the putter head shown in FIG. 8.
Figure 10:
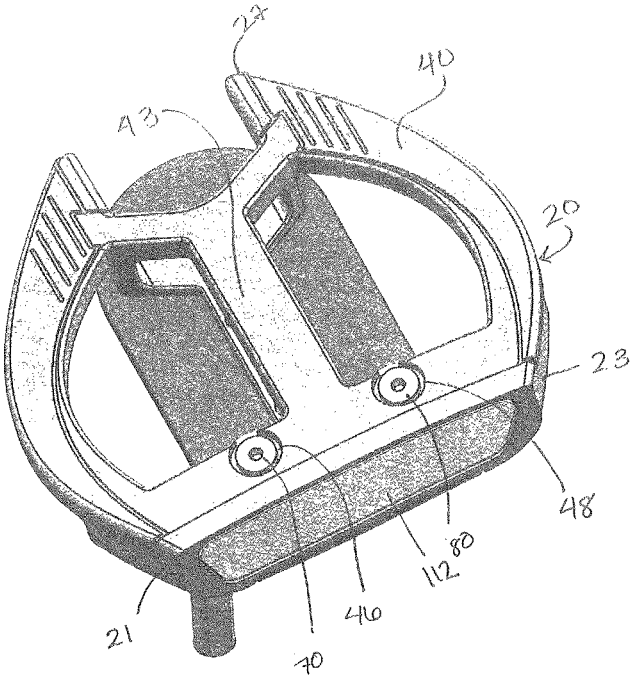
FIG. 10 is a sole perspective view of the putter head shown in FIG. 8.

The present invention is directed to a golf club head, and particularly a putter head, with a replaceable face insert.

In a first embodiment, shown in FIGS. 1-7, the putter head 10 has a body 20 with a heel side 21 proximate a hosel 22, a toe side 23, a front surface 24, a top portion 30 extending rearward from an upper edge 25 of the front surface 24, a sole portion 40 extending rearward from a lower edge 26 of the front surface 24, and a rear end 27. A face cavity 50 extends into the front surface 24 and communicates with a heel-side cavity 52 and a toe-side cavity 54, each of which is disposed behind the face cavity 50 along a front-to-back x-axis extending perpendicular to the front surface 24. As shown in the Figures, each of the heel- and toe-side cavities 52, 54 has a rear opening facing the rear end 27 of the body 20, but in an alternative embodiment, a rear wall (not shown) may enclose the back side of each of these cavities 52, 54.

The top portion 30 has a recessed central area 35 sized to receive the front portion of a cover piece 200. A heel-side top opening 32 extends through the top portion 30 and communicates with the heel-side cavity 52, and a toe-side top opening 34 extends through the top portion and communicates with the toe-side cavity 54. The sole portion 40 has a heel-side depression 42 extending into an interior sole surface 45 and aligned with the heel-side top opening 32 along a vertical z-axis extending perpendicular to the x-axis, and a toe-side depression 44 extending into the interior sole surface 45 and aligned with the toe-side top opening 34 along the vertical z-axis.

The body 20 engages a face insert 100 having a striking portion 110 with a striking surface 112, a rear surface 114 opposite the striking surface, and a periphery edge 116 extending approximately perpendicular to, and connecting, the striking and rear surfaces 112, 114. A sealing gasket 120 is affixed to the periphery edge 116 to ensure that there are no frontal gaps in the putter head 10 when the face insert 100 is affixed to the body 20. The sealing gasket 120 preferably does not make contact with any portion of the striking surface 112.

Cylindrical heel- and toe-side support structures 130, 140 extend from the rear surface 114 of the striking portion 110, each having an elongated through-bore 135, 145 extending along the z-axis from upper edges 132, 142 to lower edges 134, 144 of the support structure 130, 140. The upper edges 132, 142 and lower edges 134, 144 are preferably flush with the periphery edge 116 of the striking portion 110, so that the cylindrical support structures 130, 140 extend along the entire vertical height H of the striking portion 110, but in alternative embodiments, the cylindrical support structures 130, 140 may not extend along the entire vertical height H. Each elongated through-bore 135, 145 includes a linear bearing 150, 155, which is trapped within the elongated-through bore 135, 145 between snap rings 160, 162, 164, 166 that at least partially disposed within circular grooves 131, 133, 141, 143 that are in communication with the elongated through-bores 135, 145.

The heel-side support structure 130 is sized to fit within the heel-side cavity 52, and the toe-side support structure 140 is sized to fit within the toe-side cavity. When these support structures 130, 140 are fully disposed within their respective cavities 52, 54, the striking portion 110 is seated within the face cavity 50 so that the striking surface 112 is approximately flush with the front surface 24 of the body and the sealing gasket 120 creates a seal between the face insert 100 and the body 20. Fully engaging the face insert 100 with the body 20 also causes the elongated through-bore 135 in the heel-side support structure 130 to align with the heel-side top opening 32 and the heel-side depression 42, and the elongated through-bore 145 in the toe-side support structure 140 to align with the toe-side top opening 34 and the toe-side depression 44.

Once the face insert 100 is disposed within the cavities 50, 52, 54 of the body 20 as described above, retaining rods 170, 180 are used to secure the face insert 100 to the body 20. The first retaining rod 170 is inserted into the heel-side elongated through-bore 135 through the heel-side top opening 32 so that it extends through the bore 152 in the linear bearing 150 and a lower end 172 abuts the heel-side depression 42. The second retaining rod 180 is inserted into the toe-side elongated through-bore 145 through the toe-side top opening 34 so that it extends through the bore 157 in the linear bearing 155 and a lower end 182 abuts the toe-side depression 44. The linear bearings 150, 155 help to snugly retain the retaining rods 170, 180 within their respective elongated through-bores 135, 145. Each retaining rod 170, 180 has tapered upper and lower ends 174, 184, 182, which helps to center the retaining rods 170, 180, within their respective, elongated through-bores 135, 145, and to engage the depressions 42, 44 in the sole portion 40.

When the retaining rods 170, 180 are fully engaged with the face insert 100 and the body 20, the cover piece 200 is attached to the body 20 to reversibly fix the retaining rods 170, 180 in place. The cover piece 200 comprises an external surface 205 with alignment markings 210 and an internal surface 220 with a pair of bosses 222, 224, one extending from a frontal heel side of the cover piece 200, and the other extending from a frontal toe side of the cover piece 200. The heel side boss 222 receives the tapered upper end 174 of the first retaining rod 170, and the toe side boss 224 receives the tapered upper end 184 of the second retaining rod 180. The cover piece 200 preferably is then reversibly affixed to the body 20 with snap features, temporary adhesive material, and/or mechanical fasteners such as bolts or screws (as shown in FIGS. 8-12); doing so places pressure on the retaining rods 170, 180 and holds them, and the face insert 100, in place within the body 20. The front portion 215 of the cover piece 200, which is received by the recessed central area 35 of the top portion 30, preferably is thinner than the rear portion 217 of the body so that the putter head 10 has a flush upper surface 15.

A second, preferred embodiment of the present invention is shown in FIGS. 8-12. This putter head 10 has most of the same features as the embodiment shown in FIGS. 1-7, but instead of retaining rods 170, 180, the putter head 10 of the preferred embodiment includes a pair of elongated bolts 70, 80, also referred to as mechanical fasteners, which are inserted into the body 20 via the sole portion 40 instead of the top portion 30. Each bolt 70, 80 has a head portion 72, 82, an elongated extension portion 74, 84, and a threaded tip portion 76, 86, while the sole portion 40 comprises a heel-side sole opening 46 surrounded by a heel-side flange portion 47 and a toe-side sole opening 48 surrounded by a toe-side flange portion 49.

The cover piece 200 in this embodiment includes heel- and toe-side threaded internal bores 230, 235, each of which is supported by a raised boss 240, 245 extending from the external surface 205 of the cover piece 200. When the cover piece 200 is properly disposed on the body 20, the heel-side threaded internal bore 230 vertically aligns with the heel-side opening 46, and the toe-side threaded internal bore 235 vertically aligns with the toe-side opening 48. The cover piece 200 in this embodiment also includes first and second through-bores 250, 255 at a middle section 214, through which smaller bolts 90, 92 are inserted to engage threaded bores 94, 96 located in a middle region 43 of the sole portion 40. In this way, the cover piece 200 can be reversibly affixed to the body 20.

Figure 11:
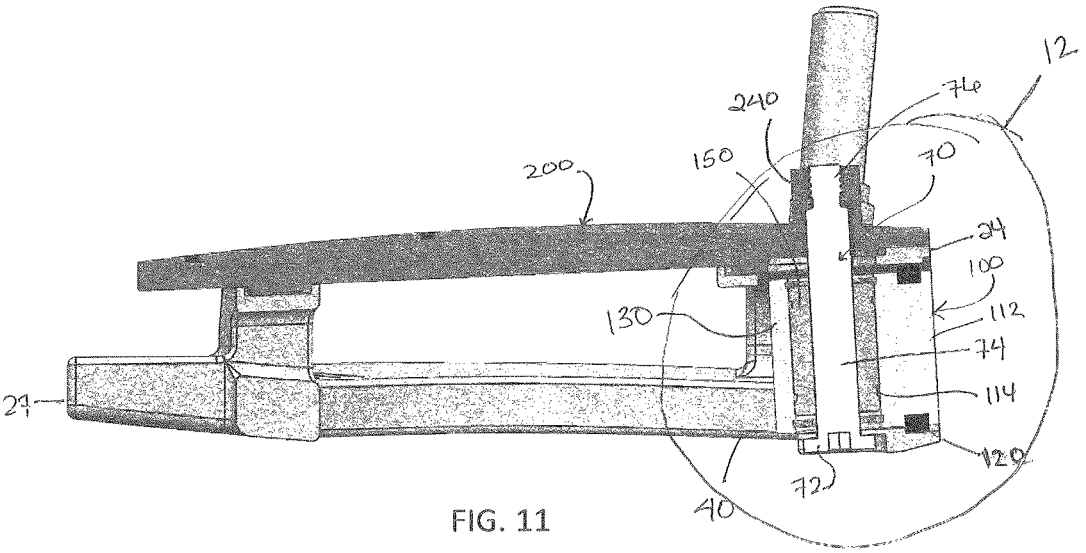
FIG. 11 is a cross-sectional view of the putter head shown in FIG. 8 along lines 11-11.
Figure 12:
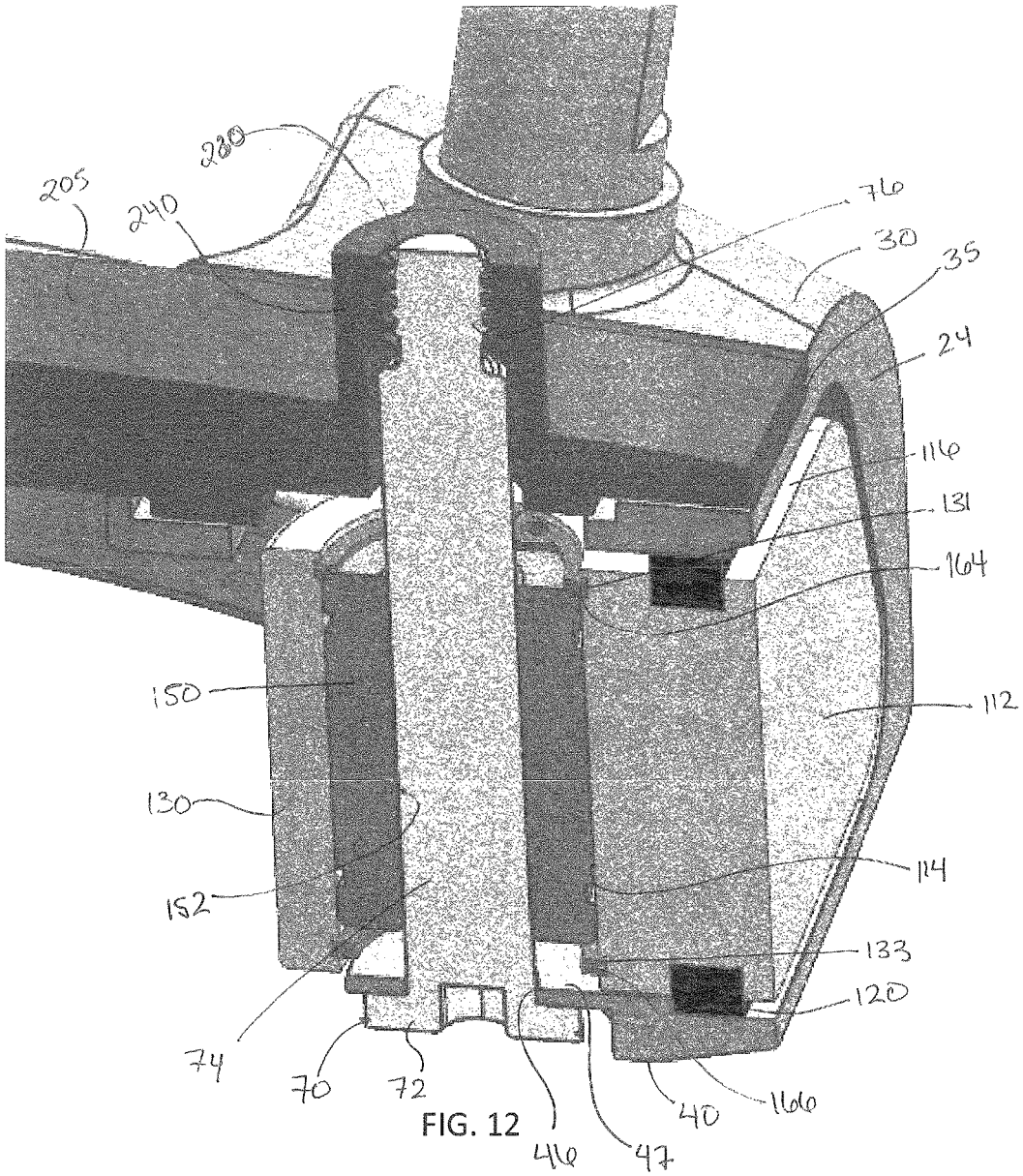
FIG. 12 is an enlarged view of the circled portion of the putter head shown in FIG. 11.
Figure 13:
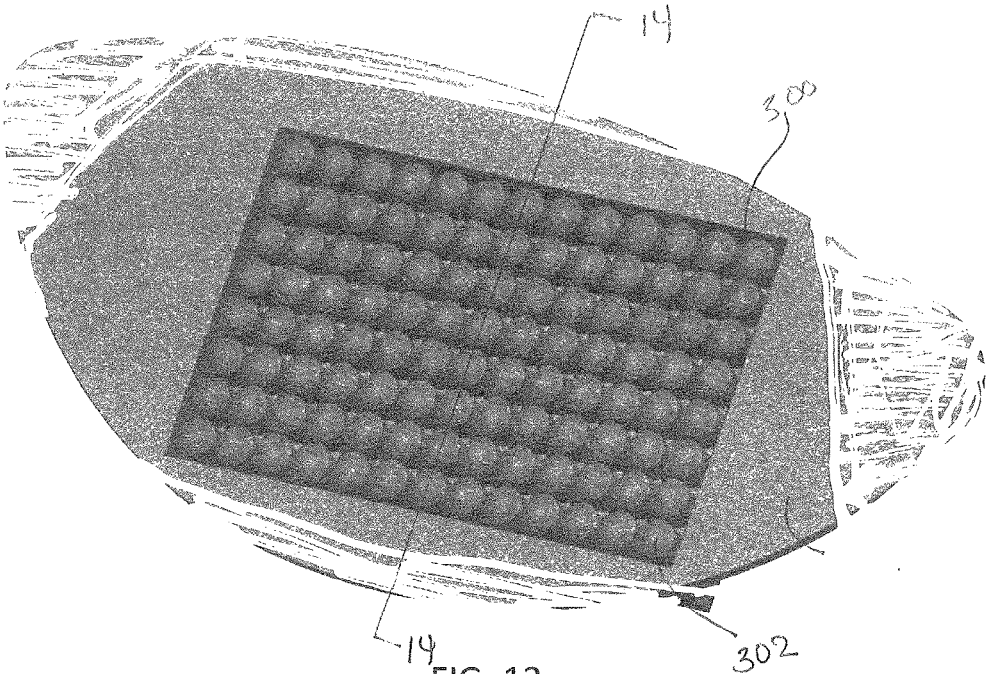
FIG. 13 is an alternative face insert pattern for use with the face insert shown in FIG. 4.
Figure 14:
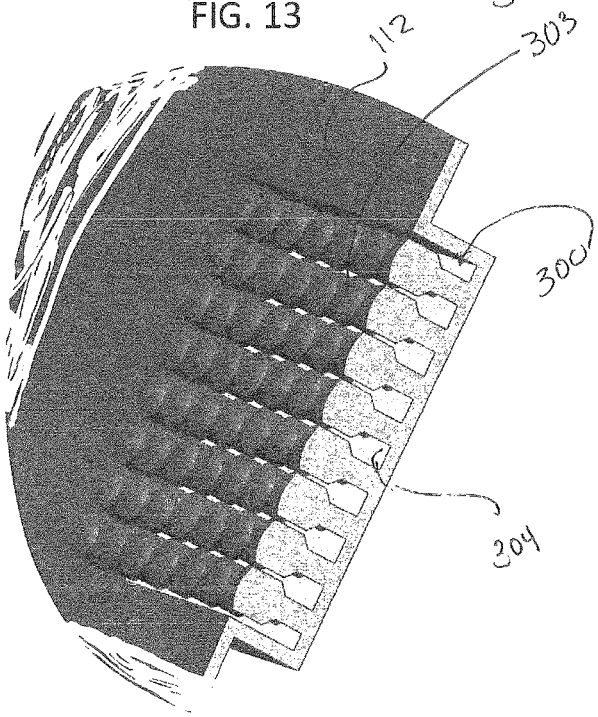
FIG. 14 is a cross-sectional view of the face insert shown in FIG. 13 along lines 14-14.
Figure 15:
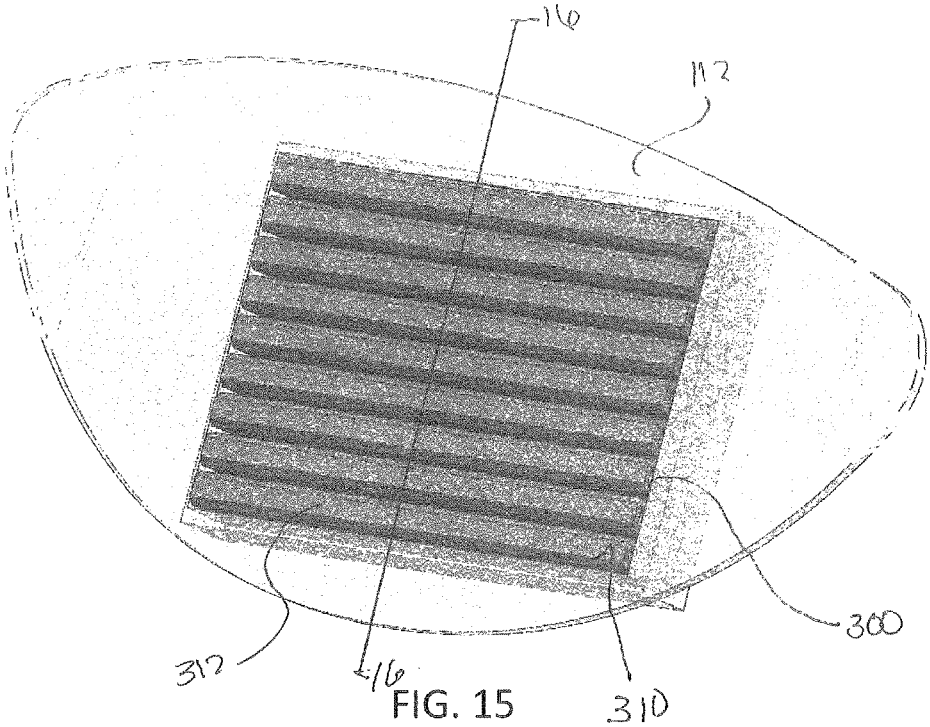
FIG. 15 is another face insert pattern for use with the face insert shown in FIG. 4.
Figure 16:
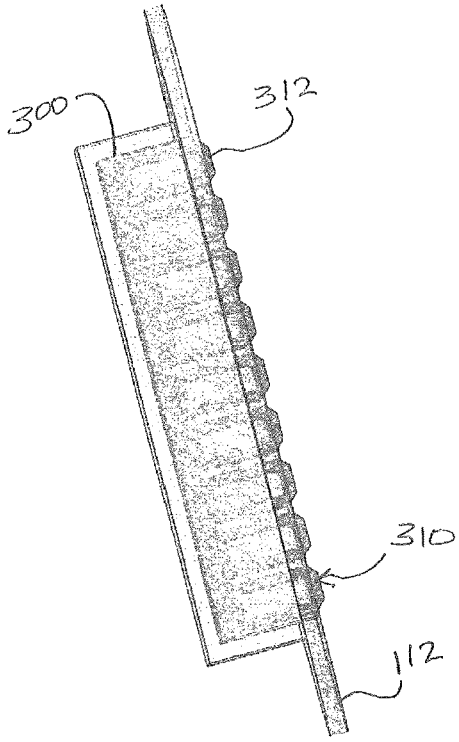
FIG. 16 is a cross-sectional view of the face insert shown in FIG. 15 along lines 16-16.

As shown in FIGS. 11 and 12, when each of the cover piece 200 and the face insert 100 is fully engaged with the body 20, the bolt 70 is attached to the body 20 by threading the elongated extension portion 74 through the heel-side sole opening 46, through the elongated through bore 135, and through the bore 152 in the linear bearing 150, until the threaded tip portion 76 engages the heel-side threaded internal bore 230 and the head portion 72 abuts an external surface of the heel-side flange portion 47. The other bolt 80 is attached to the body in the same way, threading the elongated extension portion 84 through the toe-side sole opening 48, through the elongated through-bore 145, and through the bore 157 in the linear bearing 155, until the threaded tip portion 86 engages the toe-side threaded internal bore 235 and the head portion 82 abuts an external surface of the toe-side flange portion 49. Tightening the bolts 70, 80 puts them in tension between the cover piece 200 and the sole portion 40.

In an alternative embodiment, instead of a removable cover piece 200, the heel- and toe-side threaded internal bores 230, 235 may be integrally formed with the top portion 30 of the body 20, such that the body does not require a separate cover piece 200 to cap off any openings in the top portion 30.

The present invention is useful to a golfer because they can select a preferred putter body 20 and a preferred face insert 100 separately from one another. As shown in FIGS. 1-7, the face insert 100 of that embodiment includes striking face technology described in U.S. Pat. Nos. 9,577,484, 9,265,996, 8,915,798, 8,696,492, or 8684860, the disclosure of each of which is incorporated by reference in its entirety herein. In the embodiment shown in FIGS. 8-12, the face insert 100 includes White Hot striking face technology, such as that disclosed in U.S. Pat. Nos. 6,238,302, 6,273,831, or 6273832, the disclosure of each of which is incorporated by reference in its entirety herein. Some alternative striking surface 112 options are shown in FIGS. 13-16. In the embodiment shown in FIGS. 13 and 14, the striking surface 112 comprises a recessed area 300 with a plurality of bulbous bristles 302 extending perpendicular from the recessed base 304, such that the top edges 303 of the bristles are flush with the rest of the striking surface 112. In the embodiment shown in FIGS. 15 and 16, the striking surface 112 comprises a recessed area 300 filled with an insert 310 made up of rows of hollow, rectangular tubes 312 elongated along the heel-to-toe y axis, each of which can move upon impact with a golf ball independently of other tubes 312. In still other embodiments, the face insert 100 may comprise the technology disclosed in U.S. Pat. No. 9,776,051, the disclosure of which is hereby incorporated by reference in its entirety herein.

Each piece of the putter head 10 preferably is composed of a high strength material, such as titanium alloy or stainless steel, though the linear bearings 150, 155 preferably are composed of an anodized aluminum alloy with a Frelon® liner coating. Alternatively, portions of the putter head 10, such as the hosel 22 or the cover piece 200, can be formed of a lighter weight material such as aluminum ally, carbon composite, or plastic to reduce the overall weight of the putter head 10 and ensure a low center of gravity. The material composition of the different parts of the putter head 10 can, however, be adjusted as desired by the golfer to change the center of gravity location.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim:

1. A putter head comprising:

a body comprising a front surface, a top portion extending from an upper edge of the front surface, a sole portion extending from a lower edge of the front surface, a rear portion, a first cavity extending into the front surface, a second cavity disposed behind, and in communication with, the first cavity, and a top opening extending through the top portion and in communication with the second cavity;

a face insert comprising;

a striking portion comprising a striking surface and a rear surface opposite the striking surface, the striking portion sized to fit within the first cavity;

a support structure extending from the rear surface, the support structure sized to fit within the second cavity; and an elongated through-bore extending through the support structure in a top-to-bottom direction;

a rod sized to fit through the top opening and within the elongated through-bore, the first rod comprising an upper end and a lower end; and a cover, wherein, when the striking portion is disposed within the first cavity and the support structure is disposed within the second cavity, the elongated through-bore is vertically aligned with the top opening, wherein, when the striking portion is disposed within the first cavity and the support structure is disposed within the second cavity, the rod is inserted into the elongated through-bore via the top opening and extends through the elongated through-bore so that the lower end abuts the sole portion, and wherein the cover is affixed to the top portion so that the upper end of the rod abuts a portion of the cover.

2. The putter head of claim 1, wherein each of the upper and lower ends of the rod is tapered.

3. The putter head of claim 1, further comprising a linear bearing disposed within the elongated through-bore.

4. The putter head of claim 3, further comprising first and second snap rings, wherein the support structure comprises a first circular groove proximate an upper end of the elongated through-bore and a second circular groove proximate a lower end of the elongated through-bore, wherein the first snap ring is disposed within the first circular groove above the linear bearing, and wherein the second snap ring is disposed within the second circular groove below the linear bearing.

5. The putter head of claim 1, wherein the sole portion comprises a sole internal surface having a depression sized to receive the lower end of the rod.

6. The putter head of claim 1, wherein the cover comprises a cover internal surface, and wherein a boss sized to receive the upper end of the rod extends from the cover internal surface and is aligned with the top opening when the cover is affixed to the body.

7. The putter head of claim 1, wherein the rod is compressed between the cover and the sole portion.

8. The putter head of claim 1, wherein the cover comprises an outer surface having alignment markings.

9. The putter head of claim 1, wherein the cover is reversibly affixed to the body.

10. The putter head of claim 1, further comprising a sealing gasket extending around a periphery of the striking portion.

11. A putter head comprising a body comprising a front surface, a top portion extending from an upper edge of the front surface, a sole portion extending from a lower edge of the front surface, a heel side, a toe side, a face cavity extending into the front surface, a heel side cavity disposed behind, and in communication with, the face cavity, a toe side cavity disposed behind, and in communication with, the face cavity, a heel side top opening extending through the top portion and in communication with the heel side cavity, and a toe side top opening extending through the top portion and in communication with the toe side cavity;

a face insert comprising;

a striking portion comprising a striking surface and a rear surface opposite the striking surface;

a heel side support structure extending from the rear surface and comprising a first elongated through-bore; and a toe side support structure extending from the rear surface and comprising a second elongated through-bore;

first and second tapered rods; and a cover comprising an external surface with alignment markings, wherein the striking portion is sized to fit within the face cavity so that the striking surface is approximately flush with a portion of the front surface, wherein the heel side support structure is sized to fit within the heel side cavity so that the first elongated through-bore aligns with the heel side top opening, wherein the toe side support structure is sized to fit within the toe side cavity so that the second elongated through-bore aligns with the toe side top opening, wherein the first tapered rod is disposed within the first elongated through-bore and is trapped between the sole portion and the cover, and wherein the second tapered rod is disposed within the second elongated through-bore and is trapped between the sole portion and the cover.

12. The putter head of claim 11, wherein the cover comprises an internal surface with heel and toe side bosses, wherein an upper end of the first tapered rod is received in the heel side boss, and wherein an upper end of the second tapered rod is received in the toe side boss.

13. The putter head of claim 11, wherein the sole portion comprises a heel side depression and a toe side depression, wherein the heel side depression is located within the heel side cavity and is vertically aligned with the heel side top opening, wherein the toe side depression is located within the toe side cavity and is vertically aligned with the toe side top opening, wherein the heel side depression receives a lower end of the first tapered rod, and wherein the toe side depression receives a lower end of the second tapered rod.

14. The putter head of claim 11, further comprising a first linear bearing disposed within the first elongated through-bore and around the first tapered rod and a second linear bearing disposed within the second elongated through-bore and around the second tapered rod.

15. The putter head of claim 11, further comprising a sealing gasket extending around a periphery of the striking portion.

16. A putter head comprising:

a body comprising a front surface, a top portion extending from an upper edge of the front surface, a sole portion extending from a lower edge of the front surface, a first cavity extending into the front surface, a second cavity disposed behind, and in communication with, the first cavity, a sole opening extending through the sole portion and in communication with the second cavity, and a threaded bore extending into an inner surface of the top portion;

a face insert comprising;

a striking portion comprising a striking surface and a rear surface opposite the striking surface;

a support structure extending from the rear surface; and an elongated through-bore extending through the support structure in a top-to-bottom direction; and a mechanical fastener comprising a head portion, an extension portion, and a threaded portion, wherein the sole opening is encircled by a flange portion, wherein the threaded bore is in communication with the second cavity and is vertically aligned with the sole opening, wherein the striking portion is sized to fit within the first cavity so that the striking surface is approximately flush with a portion of the front surface, wherein the support structure is sized to fit within the second cavity so that the elongated through-bore aligns with the sole opening and the threaded bore, and wherein the threaded portion of the mechanical fastener engages the threaded bore, the extension portion of the mechanical fastener extends through the elongated through-bore, and the head portion abuts the flange portion to reversibly fix the face insert to the body.

17. The putter head of claim 16, further comprising a linear bearing, wherein the linear bearing is disposed within the elongated through-bore, and wherein the extension portion extends through the linear bearing.

18. The putter head of claim 17, further comprising first and second snap rings, wherein the support structure comprises a first circular groove proximate an upper end of the elongated through-bore and a second circular groove proximate a lower end of the elongated through-bore, wherein the first snap ring is disposed within the first circular groove above the linear bearing, and wherein the second snap ring is disposed within the second circular groove below the linear bearing.

19. The putter head of claim 16, further comprising a sealing gasket extending around a periphery of the striking portion.

20. The putter head of claim 16, wherein the support structure is approximately cylindrical.

* * * * *